US005253709A

United States Patent [19]

Kendrick et al.

[11] Patent Number: 5,253,709

[45] Date of Patent: Oct. 19, 1993

[54] METHOD AND APPARATUS FOR SEALING PIPE PERFORATIONS

[75] Inventors: Larry N. Kendrick, Lafayette, La.; William A. Savage, Edmond, Okla.

[73] Assignee: Conoco Inc., Ponca City, Okla.

[21] Appl. No.: 720,044

[22] Filed: Jun. 24, 1991

Related U.S. Application Data

[63] Continuation-in-part of Ser. No. 472,519, Jan. 29, 1990, abandoned.

[51] Int. Cl.[5] ..... E21B 33/13

[52] U.S. Cl. ..... 166/284; 166/193

[58] Field of Search ..... 166/284, 193, 281; 273/58 F

[56] References Cited

U.S. PATENT DOCUMENTS

| | | | |
|---|---|---|---|
| 450,759 | 4/1891 | Peterson | 273/58 F |
| 2,754,910 | 7/1956 | Derrick et al. . | |
| 2,933,136 | 4/1960 | Ayers et al. . | |
| 2,951,255 | 9/1960 | Ver Nooy | 166/153 X |
| 3,011,548 | 12/1961 | Holt . | |
| 3,376,934 | 4/1968 | Willman et al. | 166/284 |
| 3,437,147 | 4/1969 | Davies | 166/193 X |
| 4,407,368 | 10/1983 | Erbstoesser | 166/284 |
| 4,505,334 | 3/1985 | Doner et al. | 166/284 |
| 4,531,742 | 7/1985 | Craycraft | 273/58 F |
| 4,702,316 | 10/1987 | Chung et al. | 166/272 |
| 4,716,964 | 1/1988 | Erbstoesser et al. | 166/284 |
| 4,872,676 | 10/1989 | Townsend | 273/58 F |

*Primary Examiner*—Hoang C. Dang

*Attorney, Agent, or Firm*—David W. Westphal; John E. Holder

[57] ABSTRACT

Ball sealers for flowing into casing perforation holes in a wellbore to selectively seal off those perforations receiving a disproportionately large amount of well treatment fluid being injected through the perforations. The ball sealers (22) are comprised of a spherical outer deformable shell (42) defining a central core portion filled with nondeformable particulate matter (46) which is sized small enough to flow with the shape of the deformable outer shell (42) and large enough so that as it consolidates under the force of fluid flow pressure, it will cause the outer shell to bridge over the perforation opening (18) when the force of fluid flowing into the casing (12) pushes the ball sealer (22) against and into the perforation opening (18). The particles (46) are also arranged so that when fluid flow is stopped into the casing and the fluid flow force is no longer applied to the ball seals, the particulate matter (46) will become unconsolidated to relax the bridge and permit the entrapped energy in the deformed outer shell (42) to expel the ball from the perforation opening.

18 Claims, 1 Drawing Sheet

METHOD AND APPARATUS FOR SEALING PIPE PERFORATIONS

This application is a continuation of U.S. Pat. No. 9,100,225 filed Jan. 7, 1991, which in turn is a continuation-in-part of U.S. patent application Ser. No. 07/472,519 filed Jan. 29, 1990, now abandoned.

BACKGROUND OF THE INVENTION

This invention relates to ball sealers for plugging perforations in a pipe and more particularly to ball sealers which will selectively bridge across perforations that are receiving a disproportionately large amount of well treatment fluid being injected into a wellbore.

During the drilling and in the operation of oil, water, or gas wells, it is often necessary to treat the borehole or earth formations penetrated by the borehole with a variety of treatment processes including fracturing, acidizing, or the like where fluids and materials are pumped into the wellbore from the surface and thence through casing perforation openings downhole into earth formations.

In such treating operations, it often occurs that a disproportionately large amount of the treating fluid or pumpable material passes through one or more of the several perforations in the casing.

The flow of a disproportionately large amount of treating material through one or a few perforations in the casing may be attributable to the higher permeability of the formation adjacent to those perforations. If the treating fluid may be easily pumped through one or a few perforations, it is often impossible to pump enough fluid into the well to build up sufficient hydrostatic pressure in the wellbore to force fluid or treating material through the perforations communicating with less permeable formations or generally impermeable sections of the earth formations.

One solution to the above-recited problem involves temporarily plugging at least some of the perforations communicating with the permeable sections of earth formations during the injection of treatment materials so that the hydrostatic pressure in the wellbore is permitted to develop to the extent that treatment fluids and materials are forced into the less permeable sections of the earth formation through other perforations which remain open. Ball sealers have been developed in the industry for accomplishing this selective plugging process to solve this fluid loss problem.

These ball sealing elements are usually made of rubber or of a hard-core material surrounded by a resilient outer covering. The balls are inserted into the well as fluid is pumped through the perforations. The balls are carried along by the flowing stream of fluid and seat against the casing perforations through which the preponderance of fluid passes, i.e., those perforations communicating with permeable sections of earth formation. Once seated against a perforation, the ball sealer element plugs the perforation and is held in place by the pressure against it of the fluid in the casing to thereby prevent passage of the fluid in the casing through the plugged perforations. Such ball sealers are shown in U.S. Pat. No. 2,754,910, issued Jul. 17, 1956, to Derrick; U.S. Pat. No. 3,011,548, issued Dec. 5, 1961, to Holt; U.S. Pat. No. 2,933,136, issued Apr. 19, 1960, to Ayers et al.; and U.S. Pat. No. 4,702,316, issued Oct. 27, 1987, to Chung et al. U.S. Pat. No. 4,702,316 shows a ball sealer composed of a polymer compound covered with an elastomer.

One disadvantage to the ball sealers in the patents listed above is that the plugging ball or element becomes lodged in the perforation so that when hydrostatic pressure in the wellbore is reduced, the ball sealer remains positioned in the perforation. Thus, the formation adjacent such permanently sealed perforations is no longer in communication with the wellbore, which would not only prevent treating materials from reaching those portions of the formation, but would also result in a decrease in production from that portion of the well served by those perforations.

Another problem encountered with ball sealers is that perforations are not always round, and a spherical ball may not be effective to bridge across the perforation opening which may have been formed as an irregular opening or later becomes split or cracked as a result of stress and chemical action in the wellbore. In any event, ball sealers of a conventional, spherically fixed configuration do not effectively seal such irregular openings. U.S. Pat. No. 3,376,934 issued Apr. 9, 1968, to Bertram proposes a solution to such a problem by providing a partially spheroidal body and a flexible skirt of fluid impervious material attached to and extending outwardly about the body to overspread the wall surface adjacent the perforation. This apparatus also is subject to becoming deformed to the extent that it may become permanently lodged in the perforation to thereby permanently close off such opening. One solution to this permanent sealing problem is suggested in U.S. Pat. No. 4,716,964, issued Jan. 5, 1988, to Ertsloesser et al., wherein the ball sealer is made of degradable material. This system requires that the chemical environment of the wellbore be maintained compatible with the materials of which the balls are made. Degradation of the material is also dependent on the wellbore fluid chemistry.

It is, therefore, an object of the present invention to provide a sealer device which can be pumped under fluid pressure into plugging contact with wellbore perforations that are receiving a disproportionate flow of fluids and which sealer devices will then release themselves from such plugging contact upon decrease in fluid pressure in the wellbore.

SUMMARY OF THE INVENTION

With this and other objects in view, the present invention relates to a ball sealer for sealing off perforations in a wellbore wherein the sealers are comprised of an impermeable outer deformable shell defining a central core portion, which core portion is filled with nondeformable particulate matter that is sized to flow into the shape assumed by the deformable outer shell. While the particulate matter is small enough to flow with and thereby accommodate a change in the shape of the outer shell, it is large enough so that as it consolidates under the force of fluid flow pressure pushing the sealer against a perforation, it will cause the impermeable outer shell to bridge over the perforation opening when the fluid flowing into the casing perforation forces the ball sealer against and somewhat into the opening. Since the particulate matter is nondeformable, it will not hold or store compressed energy when pushed into the opening. Therefore, when fluid pressure is reduced and the force against the sealer is thereby reduced, the particulate matter will become unconsolidated to relax the bridge and permit the entrapped energy in the deformed outer shell to expel the ball from the perforation opening.

DETAILED DESCRIPTION OF THE PREFERRED EMBODIMENTS

Figure 1:
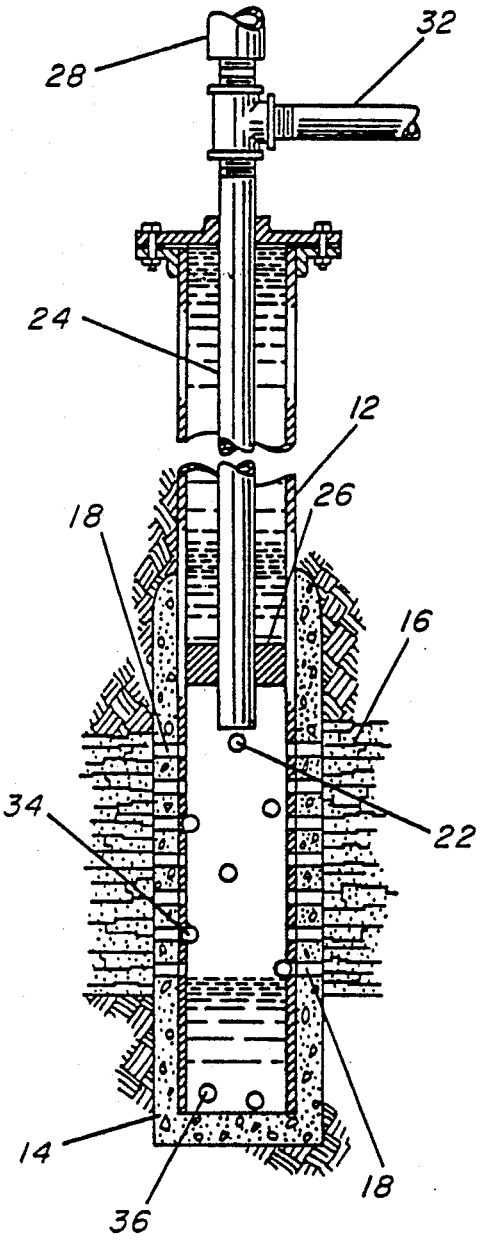
FIG. 1 is a diagrammatic sectional view of a perforated oil well with ball sealers being pumped into the well.

Referring first to FIG. 1 of the drawings, a casing 12 is run to the bottom of the well and cemented as at 14 around the outside at least to a distance above the producing formations 16, as shown. The casing 12 and the cement 14 are then perforated by any one of various means to provide a fluid communication channel between the producing formations and the interior of the casing. If the well does not come into production, it is then a common practice to treat the well by some process which will open up the producing formation to allow a ready passage of formation fluids into the wellbore. Such remedial treatment operations may also be employed in an older producing well when the production therefrom has diminished to an uneconomical level. In any event, such treatment processes typically include acidizing, hydraulic fracturing, or the like which involve pumping a treating material down the casing and into the producing formation through the perforations 18 which extend through the casing and into the earth formations. Exceedingly high pressures are sometimes used in such treatment operations with pressures of 10,000 psi not being unusual. It is well recognized that under these conditions, treating materials will preferentially flow through certain of the perforation more readily than through others. It is apparent then that only that part of the formation which is receiving this preferential flow is being subjected to the intended treatment. It, therefore, becomes desirable to selectively close off those perforations through which the highly disproportionate share of materials are flowing so that the treatment materials will be forced to act on the formation adjacent to the other perforations.

In order to accomplish this, balls 22 are introduced into the treating materials which are being pumped into the casing 12. The wellbore shown in FIG. 1 utilizes a tubing string 24 which is suspended in the wellbore from the surface and having an open lower end thereof terminating near the producing formations 16. A packer 26 is provided about the outside of the tubing 24 and is arranged to seal the annular space between the tubing 24 and the casing 12, above the perforations is in the casing. The treating material is pumped down and out the end of the tubing 24 and through the perforations 18 in the casing and cement into the adjacent formation. The balls 22 are introduced through a lubricator 28 at the surface and are moved down the tubing 24 with the treating materials which are entering the tubing through the pipe 32. The balls are forced selectively to engage the perforations such as at 34 through which the major portion of treating materials are flowing, leaving open those perforations through which the treating materials are not being injected. These balls seal off the perforations just so long as the pressure within the tubing and casing is greater than the pressure in the formation. When the pressure is reduced at the surface, the ball sealers will be released from engagement with the perforations. Thereafter, flow will be established through all of the perforations.

During the treating process, the plugs are carried by the fluid stream to the particular perforation through which the treating material is entering the formation and the sealing action can be determined readily by the increase in pressure at the well head. The plugs can be admitted or introduced as desired and move readily with the material traveling at a rate such that it can be easily determined when they will arrive at the sealing position and the plugs can be admitted one or two or as many at a time as needed according to the pressure rise and fall within the casing. During the pumping of treating material, the pressure will constantly rise until such time as the material is injected into the formation. At that time, the pressure will drop, indicating that the formation has broken down, and at this time, plugs will be introduced into the fluid stream to plug the perforations opposite the existing permeability. When this occurs, the pressure will again rise, indicating that the pressure is being exerted against another part of the formation where little or no permeability exists. When this part of the formation breaks, the pressure may again drop, at which time more plugs may be admitted to plug those perforations through which fluid is now moving. This procedure can be followed until as many formation breaks are obtained as desired, or until all of the perforations are plugged. This allows control of the fluid entry into the formation of a treating material by the sealing off of perforations adjacent to the more permeable part of the producing formation.

Figure 4:
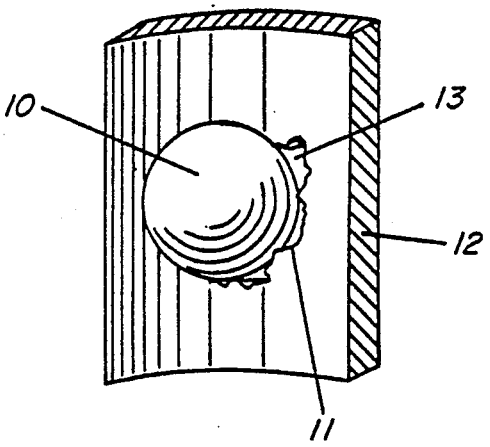
FIG. 4 shows a perspective view of a prior art ball sealer positioned in an irregular perforation in a casing wall.

One of the problems encountered when using such ball sealers in a treating operation is that the perforations are not always of a uniform circular configuration. Therefore, a spherical ball, typically having a hard solid nylon core covered with a deformable material such as rubber or the like, may be forced against the perforation to cover the greatest portion of the perforation which it can cover, but because the shape is irregular, elongated, cracked, etc., openings will extend beyond the uniform circular face of the ball. This prevents a complete seal of the perforation and may prevent the pressure buildup which is necessary to treat the formation. Thus, it is desirable to have a sealer which will be effective to cover substantially the entire open area constituting the perforation. Such a prior art sealer is shown in FIG. 4 wherein a typical ball sealer 10 is shown projecting into an irregular perforation 11 in a casing 12. It is readily seen that a substantial amount of fluid flow leakage might be possible around a sealing configuration as that shown in FIG. 4, such as through the space 13 formed between the ball 10 and irregular opening 11.

Another problem which exists in prior art ball sealers is that when the ball sealer is made of a softer yet solid rubber material, the ball will tend to enter the perforation and become lodged therein to permanently seal off the perforation. This is because the softer solid ball will deform as it enters the perforation under the differential pressure forces occurring in the treating operation and will be squeezed under compression into the perforation to create a seal. When the pressure is relieved, the compressional energy will remain trapped in the ball, holding the ball within and against the internal wall surface of the perforation opening, and will not permit release of the ball.

Figure 2:
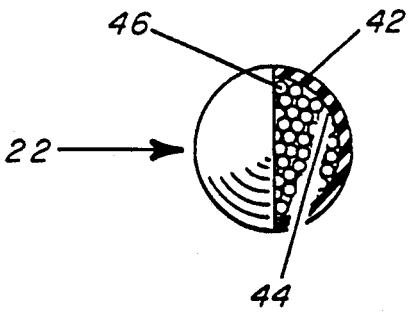
FIG. 2 is a partially cut away view of a ball sealer.

Referring now to FIG. 2 of the drawings, the ball sealer in accordance with the present invention is shown having a generally spherical configuration in its natural state under ambient conditions. An outer shell 42 is constructed of a durable yet flexible and impermeable material such as rubber to form a deformable bladder around a core portion 44 which is filled with particulate matter 46, as shown in FIG. 2. This particulate matter 46 may be comprised of beads of material such as nylon or other substantially nondeformable material. A graded material works well in that the individual particles tend to move readily relative to one another as not to assume a fixed relationship. Spherical beads would provide the ultimate mobility to the particulate core material with the size of the particles or beads being determinative of the degree of mobility. Basically, the smaller the bead, the more fluid like the core will be. On the other hand, very fine core particles will tend not to form a bridge across the opening of the perforation but rather will tend to flow through the opening. Therefore, a compromise between the desired functional qualities of fluidity and ability to bridge will determine the size of core particle. The span of the perforation opening will provide the primary parameter in determining such particle size. A rule of thumb which is used when designing treatment processes, for example, a gravel pack, is to size the particulate matter to be greater than one-sixth the diameter of the perforation to be closed by the bridging effect of gravel.

In a fracturing process, the particles are sized to be less than one-sixth the size of the perforation to ensure that the particles will flow through the perforation. Standard new perforations are nominally about 10 mm in diameter. When corrosion and wear are taken into account, 12 mm would be a good estimate for the size of old perforations. In the present ball sealer application where the particulate matter is confined within the shell enclosure, the particulate material will tend to consolidate into a bridge more easily than in loose condition and thus could be somewhat smaller in size than the rule of thumb, one-sixth perforation diameter used for gravel packs or the like. A size range of 1.5 to 3 mm or 6 to 12 mesh would be an appropriate size for the particulate matter 46 (FIG. 2) within the shell 42. The outside diameter of the shell would be sized to be approximately 22 mm or more when the perforations are about 12 mm.

In the preferred embodiment, the core of the ball sealers further comprises a temporary binder material such as a wax or similar material to bind the beads or particles together while the cover is formed about the core. The temporary binder material preferably has a melting temperature lower than the operating temperatures downhole but high enough to form a workable solid at about room temperature. Thereafter, the temporary binder material forms a liquid in the interstices of the beads or particles within the cover. The melted binder may form a lubricant causing the beads to easily slide relative to one another. Moreover, the liquid binder would be more capable of resisting the downhole compressive forces than air or other gaseous media and would therefore prevent the cover from deforming into the interstices of the beads.

The weight of the ball sealers, or more particularly, the specific gravity of the ball sealers is an important design criterion since the ball sealers are intended to flow with the well treatment fluid. If the ball sealers were too heavy or too light, they would be less inclined to flow with the fluid and plug the perforations. Therefore, the ball sealers should have approximately the same density as the well treatment fluid so as to be relative neutrally buoyant therein (i.e. the ball sealers should not necessarily float to the top or sink to the bottom). However, under some circumstances it may be preferable to provide the ball sealers with a small positive buoyancy (float relative to the fluid) and in other situations to provide ball sealers with a negative buoyancy (sink in the fluid).

The particles and the temporary binder which form the core are particularly selected so as to form ball sealers having a predetermined specific gravity. It is conventional in the art to provide sealers having a variety of specific gravities generally in the range of 1.0 to 1.3 to accommodate the variety of well treatment fluids that may be used. Based on such figures, the ball sealers of the preferred embodiment having a diameter of approximately $\frac{7}{8}$ inch would weigh generally between 0.2 and 0.26 ounces.

Figure 3:
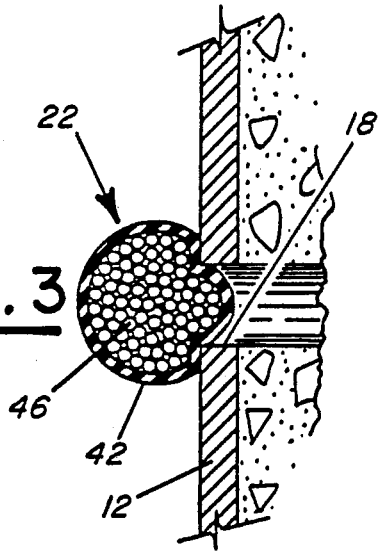
FIG. 3 shows a cross-sectional view of a ball sealer engaging a perforation in a well casing.

Turning now to an operation utilizing the ball sealers of the present invention, if it was determined that certain formations were taking treating materials in disproportion to the total flow volume, the sealers would be introduced into the flow stream through the lubricator 28 at the surface. These ball sealers 28 would then move by pumping through the tubing 24 to the borehole area below the packer 26. The balls 22 tend to move with the flow stream to the perforations taking the highest flow and thereby become forced against such perforation opening. Being larger in size than the perforation, the balls will seat against the opening, and under the influence of the differential pressure between the inside of the casing and the outer or formation side of the casing, acting against the impermeable outer shell 42, the sealers will try to flow into the perforation. Due to the manner in which this sealer is constructed, the sealer will partially flow into the perforation 18 as shown in FIG. 3.

The particles 46 making up the core of the ball sealer 22 will migrate or flow with the changing shape of the outer rubber casing 42 as it spreads over and into the perforation under the influence of hydraulic forces acting on the ball 22. Although in a relaxed or ambient state the shell 42 assumes a round shape, the thickness and nature of material making up the shell 2 is such that the shape of the sealer may readily change under the applied forces of the hydraulic system in which it is operating.

With the thief zones plugged, the other perforations will then receive entry of the treating fluids, and upon completion of the treating process, the hydraulic pressure on the system will be reduced. The sealer shell 42 will then no longer be pressed against and into the perforation so that the shell will be free to assume its static configuration of a ball. The beads not being compressed into the perforation opening will be free to flow with and follow the shape of the shell 42. This process of returning to its static state will permit the sealer to fall away from the casing wall and eventually may even fall or sink to the bottom of the hole as at 36 in FIG. 1.

While particular embodiments of the present invention have been shown and described, it is apparent that changes and modifications may be made without departing from this invention in its broader aspects, and therefore, the aim in the appended claims is to cover all such changes and modifications as fall within the true spirit and scope of the invention.

We claim:

1. In a well system having a wellbore with a perforated casing (12) extending into an earth formation (16), the formation and wellbore being such that during a well treatment operation in which pumpable material is pumped into the wellbore, a disproportionately large amount of material passes through certain perforations (18) in the casing, means for plugging the perforations which are receiving a disproportionate amount of materials being pumped into the wellbore, wherein said means comprises:

a plurality of sealing members (22) for placement into the material being pumped into the wellbore, said sealing members being characterized by an outer shell (42) having a generally fully spherical shape when not subjected to other than gravitational forces, said shell having a diameter which is larger than the diameter of perforations (18) in the casing, said shell being constructed of a material which when subjected to forces greater than the force of gravity is deformable; and a core material (46) housed within said outer shell, said core material being flowable to follow the shape of said outer shell when said outer shell is deformed.

2. The well system of claim 1 wherein said core material is comprised of particulate matter.

3. The well system of claim 1 wherein said particulate matter is substantially nondeformable.

4. The well system of claim 1 wherein said core material is comprised of a plurality of beads having a generally spherical shape.

5. The well system of claim 2 wherein individual particles of said particulate matter are sized to be at least substantially equal to or greater than one-sixth the diameter of the perforations.

6. In a well system having a wellbore with a perforated casing pipe (12) extending into an earth formation, a ball sealer (22) having a predetermined specific gravity for plugging a perforation in the wall of the pipe (12), characterized by:

a deformable outer shell portion (42) having a generally spherically shaped outer surface in its natural undeformed condition, said outer surface being sized relative to the nominal size of perforation (18) in the wall of the pipe string without passing completely through the perforation as fluid carrying the ball sealer flows into and through the perforation and causes the ball sealer (22) to deform as it flows against the perforation, said outer shell portion (42) defining an enclosed inner chamber portion (44) within said outer shell portion;

flowable core means (46) in said inner chamber portion for flowing into the shape assumed by said outer shell portion (42) as it is deformed in the process of becoming lodged in the perforation and for consolidating during deformation to bridge over the perforation so as to plug the perforation without passing completely through the perforation as fluid carrying the ball sealer flows into and through said perforation;

said ball sealer having a predetermined specific gravity comparable to the specific gravity of the fluid which carries the ball sealer so as to enhance the likelihood of the ball sealer to flow to an open, unplugged perforation and plug the same.

7. The well system of claim 6 wherein said flowable core means is comprised of a plurality of particles which are sized to form a bridge within the outer shell portion and prevent the ball sealer from passing completely through the perforation as the outer surface of said outer shell portion conforms to the shape of the perforation.

8. The well system of claim 6 wherein said core means is comprised of a plurality of spherically shaped beads.

9. The well system of claim 8 wherein said beads are made of a substantially nondeformable material.

10. The well system of claim 6 wherein the predetermined specific gravity is generally in the range of 1.0 to 1.3

11. The well system of claim 6 wherein said flowable core means comprises a plurality of particles wherein said particles (46) are of a sufficiently small size to flow with the changing shape of the deformable outer shell portion (42) when the ball sealer is forced into the perforation opening (18) in the wall of the pipe by flowing fluid.

12. The well system of claim 11 wherein said particles (46) are of a sufficiently large size to create a bridge within the outer shell portion (42) across a perforation (18) when the ball sealer is forced into the perforation opening in the wall of the pipe by flowing fluid.

13. The well system of claim 6 wherein said outer shell portion (42) is comprised of a deformable material which is impermeable and which when subjected to external forces will change its shape and further wherein said flowable core means is comprised of a plurality of generally spherically shaped substantially nondeformable beads.

14. The well system of claim 13 wherein said flowable core means is comprised of particles (46) sized to be sufficiently small to flow within the changing shape of the deformable outer shell portion (42) and sufficiently large to create a bridge within said outer shell portion across a perforation (18) when the ball sealer is forced against a perforation to thereby lodge the ball sealer within the perforation opening when the ball sealer is subjected to the force of a flowing fluid pressing the ball sealer into the perforation opening.

15. The well system of claim 6 wherein said flowable core means is comprised of a plurality of particles (46) which have a substantially uniform spherical shape in a range between 1.5 to 3 mm in diameter.

16. The well system of claim 14 wherein the outer shell portion (42) is generally in the range of 18 to 26 mm in diameter.

17. A method of plugging perforations (18) in a casing (12) in a wellbore extending from the surface and penetrating into an earth formation (16) in conjunction with a formation treatment involving the introduction of a fluid into the wellbore at the surface, with such fluid having dispersed therein a plurality of ball sealers, and said ball sealers being sized to seal said perforations; wherein the improvement is characterized by:

introducing into the fluid at the surface ball sealers being comprised of a deformable outer shell (42) having a spherical outer surface and defining an interior chamber (44) and a plurality of particles (46) within the interior chamber forming a core flowable with and capable of assuming the shape of the deformable outer shell (42); and continuing the flow of such fluid until at least a portion of the outer surface (42) of some of said ball sealers (22) has become positioned within said perforations (18) with such particles (46) flowing within the chamber (44) due to the force of the flowing fluid for forming a bridge within the outer shell across the perforations to lodge the ball sealers in the perforations.

18. The method of claim 17 wherein said particles are comprised of substantially nondeformable material and, further including discontinuing the flow of fluid into the wellbore for relieving the force of the flowing fluid on the particles within the chamber to permit the particles to flow back into a nonbridging condition and thereby permit the ball sealer to become dislodged from the perforation.

* * * * *